United States Patent [19]

Peoples

[11] 4,254,420

[45] Mar. 3, 1981

[54] WHIP ANTENNA OF REDUCED LENGTH FOR VHF RADIO COMMUNICATION

[76] Inventor: John C. Peoples, 100 E. 24th St., Riviera Beach, Fla. 33404

[21] Appl. No.: 110,121

[22] Filed: Jan. 7, 1980

[51] Int. Cl.[3] ..... H01Q 1/32; H01Q 9/18

[52] U.S. Cl. ..... 343/715; 343/861; 343/864

[58] Field of Search ..... 343/709, 710, 715, 861, 343/864, 900

[56] References Cited

U.S. PATENT DOCUMENTS

| | | | |
|---|---|---|---|
| 2,124,424 | 7/1938 | Leeds | 343/864 |
| 4,128,840 | 12/1978 | Tucker | 343/715 |

*Primary Examiner*—Eli Lieberman

*Attorney, Agent, or Firm*—Malin & Haley

[57] ABSTRACT

A VHF whip antenna of reduced physical length comprising a whiplike electrical conductor mounted atop a hollow, plastic, sealed cylindrical housing having a coaxially mounted circuit support tube mounted therein, with a highly resonant circuit attached thereto. Resonance is achieved in the circuit from a U-shaped inductance of a predetermined length mounted on the inside support tube, the inductance being coupled in series electrically with a variable capacitor. The whip conductor is designed to be three half-wave lengths long and when in combination with the resonant circuit, radiates power in perfect phase relationship that accounts for a power gain in the order of ten DB.

5 Claims, 5 Drawing Figures

WHIP ANTENNA OF REDUCED LENGTH FOR VHF RADIO COMMUNICATION

BACKGROUND OF THE INVENTION

This invention relates generally to a whip antenna and its associated tuning circuitry primarily for use in marine VHF communications. A whip antenna is essentially a vertical antenna having a whiplike conductor and insulator mounting base. In the past whip antennas as used in marine VHF radios have been approximately 20 feet in length in order to achieve a power gain of 9 DB. Use of a shorter physical length on the whip antenna has been restrictive because the power gain in the shorter antenna is unacceptable for typical VHF radio communication utilization. Although the longer standard size antenna can be more readily used in larger vessels, they are extremely cumbersome and impractical for use in small boats.

The present invention allows for the use of a much physically shorter antenna (approximately ten feet long) which still maintains an allowable gain of ten decibels which is practical for use in all size boats and other vehicles.

SUMMARY OF THE INVENTION

An improved whip antenna comprised of a hollow, plastic tubular base with a highly resonant circuit attached thereto, with the base being encased in a hollow, waterproof housing. The output of the circuit is detachably connected to a whiplike conductor of a predetermined length.

The circuit of the improved antenna includes a U-shaped inductance, one end which connects to the whip conductor while the other end of the inductance is carefully trimmed in very small steps, 1/16 of an inch at a time in order to achieve exact resonance in conjunction with the series adjustable capacitor. The trimming step is done at the factory prior to sealing the tubular base in the cylindrical housing. The adjustment is important in order to obtain the lowest possible VSWR. It has been found that the U-shaped inductance has greater efficiency when wound with cable such as RG-58 AU rather than ordinary wire. The transmission line from the transceiver is connected at a point 1½ inches from the extreme bottom of the U-shaped inductance. This allows a good match to the 50 ohm output of the radiotelephone.

The U-shaped conductor providing inductance is physically mounted longitudinally along the exterior of the tubular base, with parallel conductor segments being diametrically opposed across the tubular base exterior. The trimmed conductor segment includes a variable capacitor in series therewith. The U-shaped conductor is firmly attached to the tubular base exterior by suitable adhesive or a tape.

The circuit is tuned for maximum resonance in order to develop an extremely high voltage, which is fed into a matched voltage fed whip, to be responsive to frequencies in the order of 156 MC. with a band width of 5 MC's. The antenna whip is designed to be three half-wave lengths long and when in combination with the resonant circuit, radiates power in perfect phase relationship that accounts for a power gain in the order of 10 DB. The total length of the improved antenna is therefore only approximately 10 feet.

It is therefore the primary objective of this invention to provide an antenna which is only approximately ten feet in length which will generate acceptable power means for use in VHF radio communications.

It is another object of this invention to provide a circuit and whip which together radiates power in perfect phase relationships.

In accordance with these and other objects which will be apparent hereinafter, the instant invention will now be described with particular reference to the accompanying drawings.

DESCRIPTION OF THE PREFERRED EMBODIMENT

Figure 1:
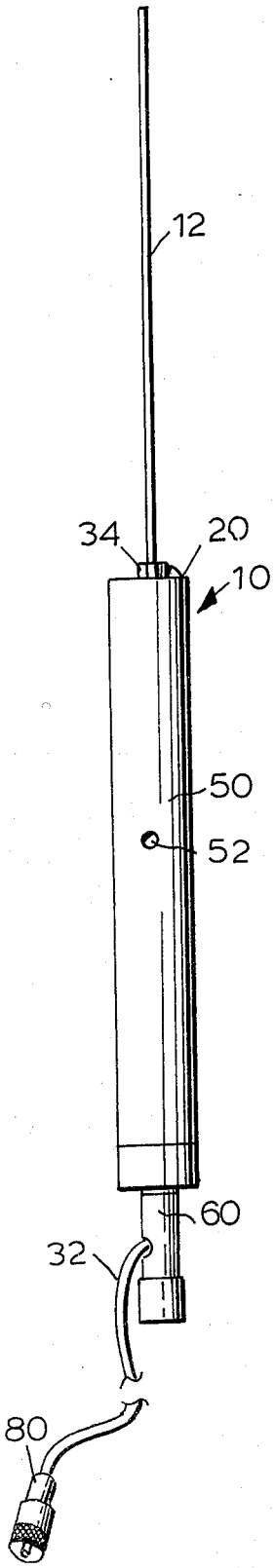
FIG. 1 shows a side elevational view of the present invention.

Referring to FIG. 1, an improved antenna 10 is shown including the circuit. A cylindrical, plastic housing 50 is used to contain the base 20 which is sealed within the housing 50 at the top of the housing. The plastic housing 50 has attached to its bottom an additional plastic, cylindrical member 60 which is one inch in diameter in order to fit in a standard antenna mount. The standard, coaxial cable 70 is attached to a standard connector 80 which connects the transceiver (not shown) to the antenna. A whip conductor 12 is electrically and mechanically connected to the base 20 at connector 34. A small aperture 52 is provided in housing 50 for adjusting a variable capacitor 18 (FIG. 3) by insertion of a small tool through aperture 52.

Figure 3:
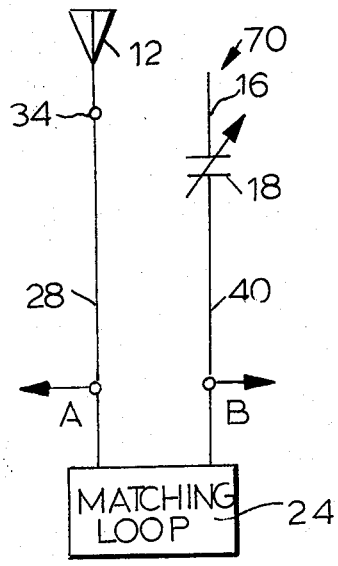
FIG. 3 shows a schematic diagram of the electrical circuitry utilized in the present invention.
Figure 2:
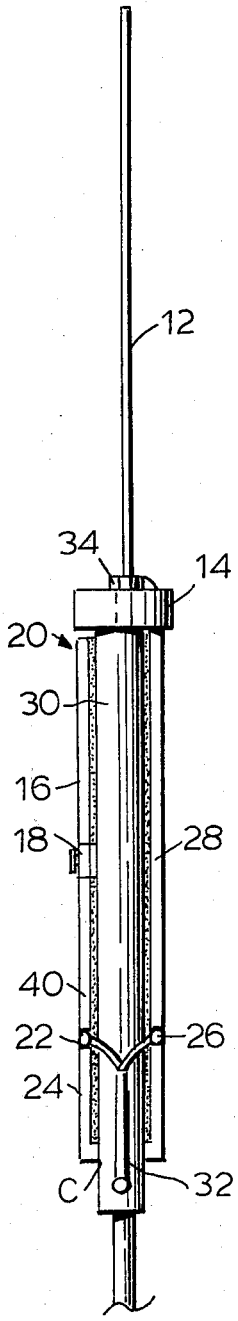
FIG. 2 shows a pictorial side elevational view showing the internal base and circuitry utilized in the present invention.
Figure 4:
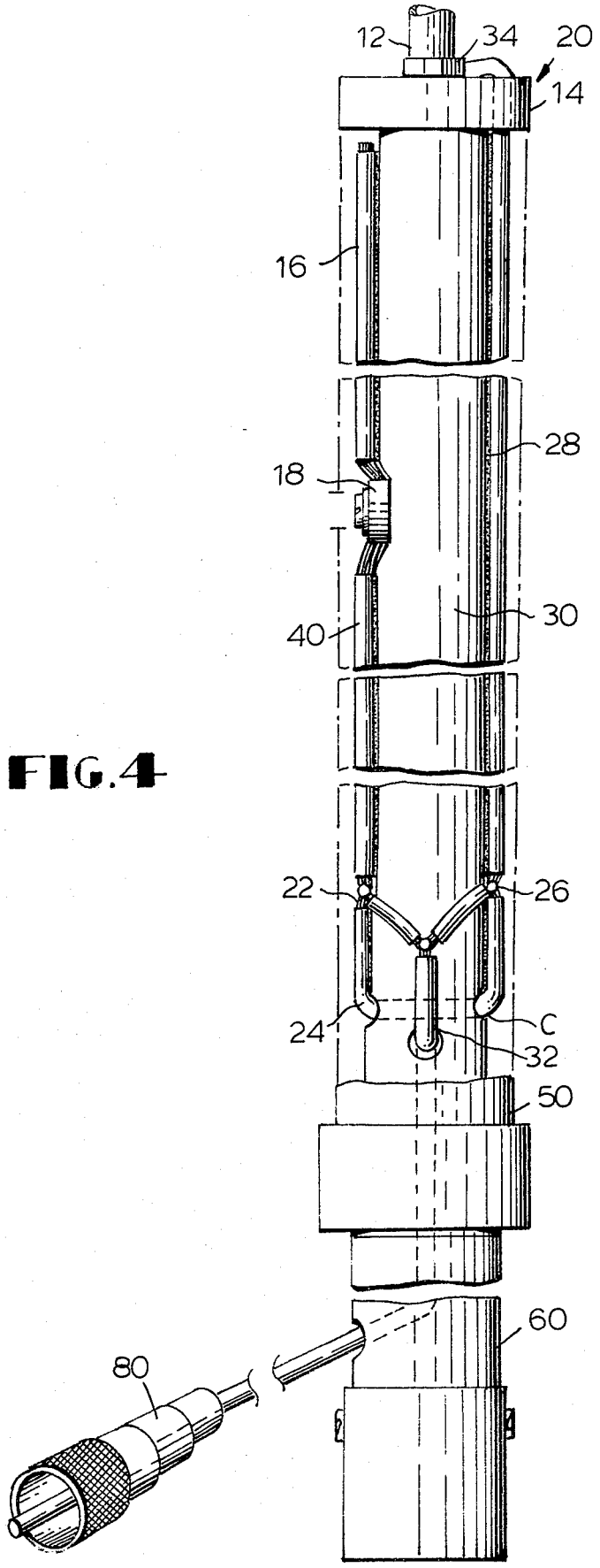
FIG. 4 shows a side elevational view of the internal base and circuitry used in the present invention.

Now referring to FIGS. 2, 3, and 4 the structure of a highly resonant circuit located in the base section 20 is shown. The body 30 of the base section 20 is structured of a hollow, plastic tube, 1⅝ inches in diameter. The hollow, plastic tube 30 is capped at the top with a plastic insulator 14 which has a conductive connector 34 attached to its outside surface. At a point C, which is vertically displaced towards the bottom of the plastic tube 30, 16¾ inches from the outside surface of the plastic cap 14, a quarter-inch hole is drilled which penetrates both surfaces of the plastic tube 30. An insulated wire is inserted through the holes drilled at point C and is bent to form a U-shaped transmission line 24. Each side of the U-shaped transmission line 24 has the insulation removed at its end to expose the conductor. The shield 22 of the coaxial cable 32 from the transceiver is connected to the right side of the U-shaped single conductor transmission line 24. The inner positive conductor 26 of the coaxial cable 32 is connected to the left side of the single conductor transmission line 24. At a point which is vertically displaced seven inches toward the bottom of the plastic housing 30 measured from the bottom edge of the plastic cap 14, a variable capacitor 18 is installed. Insulated single conductor trim stub 16 has its bottom end electrically connected to the upper terminal of the variable capacitor 18. Another insulated single conductor transmission line has one end coupled to the bottom terminal of the variable capacitor 18 and the other end attached to the shield 22 of the coaxial cable 32. The inner conductor of the coaxial cable 32 is additionally electrically connected to an insulated single conductor 28 which runs through the plastic cap 14 and has its other end electrically coupled to the conductive connector 34.

The connector 80 of FIG. 1 can be attached to any standard SWR meter. With the whip 12 installed, the length of the trimmer stub 16 is incrementally decreased, in combination with small adjustments to the variable capacitor 18 until the SWR reading reaches its lowest reading. Good adjustment of the trimming stub and the variable capacitor usually results in a SWR reading of about 1 to 1.2. These adjustments are made with the transmitter turned on low power.

To make the system responsive to frequencies in the order of 156 MC's, with a band width of at least 5 MC's, it is imperative that the whip section of the antenna be of proper length so that the base resonance will not be upset by introducing either capactive or inductive reactance. In this antenna, a length of three one-half wave length was found to be optimum. The variable capacitor 18 can be readjusted to negate any changes in the standing wave ratio as a result of transmission line length or nearby interferring structures near antenna.

Now referring to FIG. 3, the resonant loop circuit, which is attached to the base 20, shown in FIG. 2, is represented. A matching loop 24 is connected between the points A and B where the coaxial cable from the transceiver is connected, in order to match the impedance of the antenna with that of the transceiver. The circuit 70 is made resonant by adjusting the physical length of the trimming stub 16 in combination with adjusting the trimming capacitor 18 which can vary from three to twelve mmf. This allows the circuit to develop an extremely high voltage at the connector 34 which is fed into the matched voltage fed whip 12. The circuit 70 in the whip 12 radiating power, in perfect phase relationship, and equilivant power gained. Once properly tuned, the antenna will boost the radiated signal level to at least a 10 DB gain. Although the primary use of the invention is for boat installation when reduction of antenna length is important, the device may be used in other suitable environments.

Figure 5:
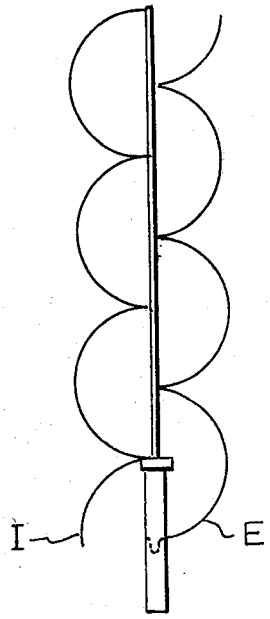
FIG. 5 is a voltage/current distribution curve for the device shown in FIGS. 1 through 4.

Referring to FIG. 5, a graphic voltage amplitude E versus current amplitude I relative to the antenna, showing maximum and zero points along the housing and whip. There is in effect a total of 4¼ wave radiators, all in phase including the base section which also radiates. The 4 high current portions of antenna account for the great power gain and low angle characteristics of this antenna.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A whip antenna of reduced length for VHF radio communication, comprised of:

a hollow, cylindrical base;

a hollow, cylindrical, waterproof housing, said hollow, cylindrical waterproof housing being sized to sealingly enclose said hollow, cylindrical base;

a cylindrical insulator cap, said cylindrical insulator cap being fixed to the top of said hollow, cylindrical base;

a conductive connector fixed to the top surface of said cylindrical, insulator cap;

an adjustable circuit with an input and an output, said adjustable circuit being attached to said hollow, cylindrical base;

a coaxial cable transmission line having one end electrically connected through said hollow, cylindrical, waterproof housing to the input of said adjustable circuit, said adjustable circuit having an input impedance which matches the impedance of said coaxial cable transmission line, and the other end electrically connected to a mating connector for mating with a transceiver;

a whip of three half-wave lengths having its lower end electrically connected to said conductive connector, said conductive connector being electrically connected to the output of said adjustable circuit, said adjustable circuit being adjusted such that there is a gain in the radiated signal level which is acceptable for VHF radio communication use.

2. A whip antenna as set forth in claim 1, wherein said adjustable circuit is further comprised of:

a U-shaped, insulated single conductor transmission line, said U-shaped, insulated, single conductor transmission line passing through two holes in said hollow, cylindrical base, said holes being vertically disposed on equal predetermined distance from the bottom edge of said cylindrical insulator cap and being circumferentially spaced apart 180 degrees, such that each side of said U-shaped, insulated, single conductor wire extends upwardly a predetermined distance along said hollow, cylindrical base, matching the input impedance of said adjustable circuit with the impedance of said coaxial cable transmission line;

a two-terminal variable capacitor fixed to said hollow, cylindrical base and being vertically disposed from the edge of said cylindrical cap by a predetermined distance and having one terminal electrically connected to one side of said U-shaped insulated, single conductor transmission line;

an insulated, single conductor trimming stub electrically connected to the other terminal of said two-terminal variable capacitor;

an insulated, single conductor, output transmission line, having one end electrically connected to the other side of said U-shaped, insulated single conductor transmission line and having the other end electrically connected to said conductive connector.

3. A whip antenna as set forth in claim 2, wherein:

the length of said insulated, single conductor trimming stub is varied in combination with incremental changes in said two-terminal variable capacitor such that when said improved antenna is electrically connected to an active transceiver set on low power and an SWR meter, the SWR meter will indicate a standing wave ratio between 1 and 1.2, said whip being connected.

4. A whip antenna as set forth in claim 1, wherein said whip antenna:

is responsive to frequencies in the order of 156 MC's with a band width of at least 5 MC's.

5. A whip antenna as set forth in claim 4, wherein:

said whip is approximately 92 inches in length.

* * * * *